US006942189B2

(12) United States Patent
Capozzi et al.

(10) Patent No.: US 6,942,189 B2
(45) Date of Patent: Sep. 13, 2005

(54) STRUCTURE CURB AND CAP ASSEMBLY FOR MOUNTING A SATELLITE DISH

(76) Inventors: Stephen J. Capozzi, 3504 Eddy La., Eau Claire, WI (US) 54703-1397; Ronald W. Dickerson, 3229 Uranus Ave., Eau Claire, WI (US) 54703; Carrie L. Bateman, 7748 Hwy. HH, Chippewa Falls, WI (US) 54729

( * ) Notice: Subject to any disclaimer, the term of this patent is extended or adjusted under 35 U.S.C. 154(b) by 0 days.

(21) Appl. No.: 10/683,492

(22) Filed: Oct. 14, 2003

(65) Prior Publication Data

US 2004/0245418 A1 Dec. 9, 2004

Related U.S. Application Data

(60) Provisional application No. 60/476,283, filed on Jun. 4, 2003.

(51) Int. Cl.[7] ..... A47G 29/02; E04G 3/08; E06B 7/28

(52) U.S. Cl. ..... 248/237; 248/122.1; 248/185.1

(58) Field of Search ..... 343/702, 878, 343/882, 765; 248/237, 122.1, 185.1, 678

(56) References Cited

U.S. PATENT DOCUMENTS

| | | | | | |
|---|---|---|---|---|---|
| 2,465,565 | A | | 3/1949 | Agner | |
| 2,681,195 | A | | 6/1954 | Bradt et al. | |
| 2,695,149 | A | | 11/1954 | Chabot | |
| 3,094,303 | A | | 6/1963 | Belger | |
| 4,028,705 | A | * | 6/1977 | Loyd | 343/715 |
| 4,115,779 | A | * | 9/1978 | Dantzler et al. | 343/715 |
| 4,181,284 | A | | 1/1980 | Seppelfrick | |
| 4,510,502 | A | | 4/1985 | Hovland et al. | |
| 4,595,165 | A | | 6/1986 | Klingensmith et al. | |
| 4,649,675 | A | | 3/1987 | Moldovan et al. | |
| 4,723,128 | A | | 2/1988 | Gasque, Jr. | |
| 4,739,337 | A | * | 4/1988 | Anderson | 343/882 |
| 4,917,345 | A | * | 4/1990 | Czech | 248/678 |
| 5,142,293 | A | | 8/1992 | Ross | |
| 5,355,145 | A | * | 10/1994 | Lucas | 343/882 |
| 5,456,433 | A | | 10/1995 | Burns et al. | |
| 5,617,680 | A | | 4/1997 | Beatty | |
| 5,646,638 | A | * | 7/1997 | Winegard et al. | 343/882 |
| 5,647,567 | A | | 7/1997 | Pugh, Jr. et al. | |
| 5,734,356 | A | * | 3/1998 | Chang | 343/882 |
| 5,829,724 | A | | 11/1998 | Duncan | |
| 5,873,201 | A | | 2/1999 | Fey | |
| 5,886,673 | A | * | 3/1999 | Thomas | 343/882 |
| 6,023,247 | A | * | 2/2000 | Rodeffer | 343/765 |
| 6,237,888 | B1 | | 5/2001 | Coll | |
| 6,276,649 | B1 | | 8/2001 | Kruse | |
| 6,343,439 | B1 | * | 2/2002 | Rutledge | 52/27 |
| 6,460,821 | B1 | | 10/2002 | Rhudy et al. | |
| 2004/0169114 | A1 | * | 9/2004 | Dierkes | 248/165 |

* cited by examiner

*Primary Examiner*—Ramon O. Ramirez
*Assistant Examiner*—Amy J. Sterling
(74) *Attorney, Agent, or Firm*—Tipton L. Randall

(57) ABSTRACT

The invention is directed to a curb and cap mounting assembly for installation on the roof or wall of a structure. The assembly comprises a curb member that includes a planar flashing portion with a central housing portion extending upwardly forming an enclosed space. The central housing portion has top and bottom openings. A cap member includes a planar top portion and a peripheral edge portion extending downwardly therefrom, the cap member is sized to fit over the top opening of the central housing portion and is reversibly fastened thereto. The cap member has a plurality of linear fasteners secured to the planar top portion. The curb and cap mounting assembly receives a communications cable from interior the structure through the bottom opening of the central housing portion into the enclosed space therein. The cable extends through the top opening of the central housing portion of the curb member and under the downward extending peripheral edge portion of the cap member and extends exterior the assembly. A communications antenna mounts to the cap member planar top portion linear fasteners. The antenna is connected to the cable to deliver communications signals interior the structure. The cable can be prewired to the curb and cap mounting assembly until the owner desires to install the satellite dish.

16 Claims, 9 Drawing Sheets

STRUCTURE CURB AND CAP ASSEMBLY FOR MOUNTING A SATELLITE DISH

CROSS-REFERENCE TO RELATED APPLICATIONS, IF ANY

This application claims the benefit under 35 U.S.C. §119 (e) of co-pending provisional application Ser. No. 60/476,283, filed 4 Jun., 2003. Application Ser. No. 60/476,283 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a device for mounting a satellite dish. More particularly, the present invention relates to a structure curb and cap assembly for mounting a satellite dish. Most particularly, the present invention relates to a structure curb and cap assembly for mounting a satellite dish that prevents water from penetrating the structure, yet is readily accessed for future mounting of a satellite dish once the structure curb and cap assembly is installed.

2. Background Information

It is common practice to mount communications antennas to the roof of a building to receive various communications signals. Roof mounting is convenient in that the antenna is out of the way and positioned high above the ground to avoid interference from other structures or trees. In order to hold the antenna in place, it is often necessary to fasten a base to the roof to support the antenna. In recent years, the use of satellite dishes to receive television and other communications signals has become very popular. The satellite dish must have an extremely stable base to provide constant support so the dish can be aligned to receive the signals from a satellite. To obtain a stable base for the satellite dish, it is preferred to secure the satellite dish mounting base directly to the roof structure and into the underlying support structure. Such fastening can lead to water leakage if care is not taken to completely seal any holes that are made. A cable leads from the satellite dish into the dwelling to bring the communications signals to televisions or computers therein. Although the cable can be fastened to the roof and enter the dwelling through a vertical wall, it is preferred that the cable penetrate the roof near the satellite dish to present a more aesthetically pleasing look. However, penetrating the roof with the cable opens another route for water to enter the structure.

Some examples of inventions involving mounting of antennas or satellite dishes for which patents have been granted include the following.

Agner, in U.S. Pat. No. 2,465,565, describes a fishpole holder that includes a bolt carrying a semi-spherical head, associated with a centrally positioned slotted cup. The cup is provided with arms terminating with horizontally disposed offset upper and lower forks, whereby the vertical angle of a pole seated in the forks may be varied indefinitely. The armed cup may also be horizontally swivelled in a complete circle to position the line end of a pole at a desired fishing point, it being understood that the equipment is to be attached to either the gunwale or seats of a boat. The semi-spherical head has depending therefrom, a rectangular shank that is carried by an anchored bracket, the same being attached to a boat, and under general conditions, the shank is pivoted within a socket of the bracket and adjustably secured to the bracket socket irrespective of the particular means for securing the bracket to a selected part of a boat.

In U.S. Pat. No. 2,681,195, Bradt et al. disclose an antenna bracket, including a principal supporting member which is U-shaped, having a vertically extending leg and an arm extending at right angles to the leg. Secured to the upper portion of the leg is the bight portion of a U-shaped member which has depending therefrom screws for working engagement into the tile, shingle, or other pitch type or equivalent roof forming a part of the building. Also welded to the leg are vertically spaced rings, which have fitted therein screws which, in combination with lock nuts, provide means for securely holding the mast of the antenna in an adjusted position relative thereto. Threadedly engaged in a nut, welded to the arm, is a threaded jack screw which is provided with a handle at one end. The upper end of the screw is provided with a swivel joint, for pivotally mounting an angular end thrust plate, which when the arms of the U-shaped member are positioned at either side of the fixed roof and when the handle is turned actuating the clamping screw, will engage the gable of the building in a secure manner without digging into the wood. As can be readily seen, the screw in engagement with the nut provides ready means for attaching a ground line to the antenna.

Chabot, in U.S. Pat. No. 2,695,149, describes a bracket for mounting an antenna mast to the roof of a building without necessitating the use of nails, screws or other fasteners which penetrate the roof or other parts of the building to thus avoid damage thereto. The invention provides a mounting bracket for an antenna mast embodying an upper clamp adapted to overlie the edge of a roof and a lower clamp positioned under the edge of the roof with means for adjusting and tightening the clamp and providing means for supporting the lower end of an antenna mast on the upper and lower clamps.

In U.S. Pat. No. 3,094,303, Belger discloses an antenna bracket that is designed to be mounted on the eave, rather than on or near the peak of the roof as are most conventional antenna-supporting devices. The bracket assemblage includes a lower horizontal leg, which is formed of an inverted U-shaped metal channel, and of a length to underlie a substantial portion of the eave and projects outwardly there beyond. On roofs wherein the cornice depends slightly below the underside of the eave, the lower bracket leg may have an elongated filler member secured on its upper surface and positioned between the leg and the undersurface of the eave, the filler abutting the depending end of the cornice to promote the rigidity of the bracket. Alternatively, it is contemplated that said lower bracket leg could be bent or deflected around the depending edge of the cornice and positioned directly against the undersurface of the eave, thus eliminating the necessity for the filler.

As best-appears in FIGS. 3 and 4, the outer end of the lower bracket leg is prodded with a pair of spaced, upstanding arms which are welded or otherwise rigidly and permanently secured thereon, and which arms are provided with a series of vertically spaced, aligned apertures. The upper leg of the bracket assemblage is also formed of metal channel and includes a straight, horizontal section which is spaced above and parallel to the lower leg, and a rigid inner section which is angled upwardly to conform generally to the slope of a conventional gable-type house roof. Welded or otherwise pertinently rigidly secured to the outer end of the upper bracket leg are a pair of spaced depending arms which are adapted to fit with the aforementioned upright arms on the lower bracket leg, and which depending arms are provided with vertically-spaced, aligned apertures.

Seppelfrick, in U.S. Pat. No. 4,181,284, describes an improved antenna bracket for mounting masts for antennas to the exterior wall of buildings having various roof and overhang dimensions. The mounting bracket can be made of parts having standard dimensions and can support an antenna, mast, and rotor, without guy wires or additional support against the roof of the building.

In U.S. Pat. No. 4,510,502, Hovland et al. disclose a lightweight mounting structure combination for small dish antennae. The structure includes an upright mast for supporting the dish antennae. The mast has an upper end for attachment to said dish and a lower end for anchoring to a rigid-type structure. The structure also has a bent strut having a lower end for anchoring to a rigid-type structure and an upper end for attachment to said mast. In addition, a second strut is provided having a lower end for anchoring to a rigid-type structure and an upper end for attachment to said mast. Further included is means for anchoring the respective lower ends of the mast, bent strut and second strut to the rigid-type structure and for attaching the respective upper ends of the bent and second struts to the mast. The means includes a bracket, a threaded bolt having a shank portion for extending through the bracket and respective end, and a nut threaded on said bolt for drawing the bracket and respective end tightly together. The bolt, nut, bracket and respective end cooperate to indicate to one tightening the nut and bolt when a predetermined extent of tightness is attained, the predetermined extent of tightness being characterized by the respective end having undergone a predetermined extent of deformation such that relative movement between the bracket and respective end is minimized. A bolted joint connection and a method for installing a dish antenna mounting structure are also provided.

Klingensmith et al., in U.S. Pat. No. 4,595,165, describe a mounting structure for satellite dish antennae and method and means for anchoring the structure to the roof or sidewall of a typical residential building, such as a house, are disclosed. The mounting structure includes a mast for supporting the dish antennae. The anchoring means includes a bar having a back portion and sides which define an open-ended channel. The sides of the bar are further provided with integral adjoining lips which extend the length of the bar. Also included in the assembly is a clamp provided with holes through which bolt means may be inserted to tighten and secure the clamp about the mounting structure's mast to the bar's lips. When so tightened, the clamp tightly engages the external surface of the mast to prevent it from torsional movement relative to the clamp.

In U.S. Pat. No. 4,649,675, Moldovan et al. disclose an apparatus for mounting an antenna on a flat roof without penetrating the waterproof membrane of the roof. The apparatus is comprised of a rigid base having a planar lower surface adapted to overlie the flat roof, ballast means carried by the base to stabilize the base, and antenna support means connected to and extending upwardly from the base.

Gasque, Jr., in U.S. Pat. No. 4,723,128, describes a roof mount for securely attaching dish antennae to roofs of houses typically supported by a plurality of spaced rafters having a two-piece frame attached to a selected portion of a roof, with one piece on top of the roof supporting the dish and its adjusting mechanism and the other piece of the frame underlying the first frame beneath the roof. A plurality of fasteners penetrates the roof and both frames and draw the frames toward each other to clamp them about the selected portion of the roof and provide steady support for the antenna.

In U.S. Pat. No. 5,142,293, Ross discloses a satellite antenna assembly that includes a nonpenetrating roof mount having a pair of rectangular ballast trays for respective placement on portions of a pitched roof forward and rearward of the crown of the roof. A hinge structure interconnects the ballast trays and overlies the crown of the roof. The ballast on the trays is concealed by covers that simulate a skylight. A satellite antenna is mounted, at one of the four corners of the ballast tray located on the rear portion of the pitched roof, on a simplified antenna support and adjustment structure that facilitates variation of the polar orientation and elevation of the antenna.

Burns et al., in U.S. Pat. No. 5,456,433, describe an antenna roof mounting, comprising a substantially solid planar foundation that may be secured to a roof substrate; a substantially closed geometric superstructure affixed to and vertically raised upon the foundation; and a mast for an antenna affixed to the superstructure.

In U.S. Pat. No. 5,617,680, Beatty discloses a satellite dish, mounted on a bracket, which in turn is mounted over an uneven surface of a roof or a wall of a house. The bracket has an elevated bridge portion for supporting a mounting foot of the satellite dish. The bridge portion is integrally connected to and supported by two narrow leg portions which in turn are integrally connected to and supported by two narrow foot portions. The bridge portion is elevated from two foot portions by the leg portions in order to clear the uneven surface of the roof or wall of the house.

Pugh, Jr. et al., in U.S. Pat. No. 5,647,567, describes an adjustable satellite antenna mounting bracket that reinforces the eaves of a building roof. The antenna mounting bracket has a telescoping support having a rigid tubular form. The telescoping support has a back plate on one end that is secured to the sidewall of the building adjacent to the eave of the building. On the other end of the telescoping support is a base mount plate having a generally rectangular form adapted for accepting the base of a satellite antenna. The base mount plate that protrudes past the outer edge of the eave permits unobstructed reception of satellite signals. The telescoping support is braced by a brace. The brace cradles the telescoping support in normal conditions, but in the event of severe weather, the brace maintains the position of the support. An extension lock fixes the length of the telescoping support and acts to reinforce the eave.

In U.S. Pat. No. 5,829,724, Duncan discloses an antenna-mounting structure for mounting an antenna to a vertical wall or on a sloped, peaked, or horizontal roof. A primary strut, which is tubular, has a straight, upper portion, a straight, intermediate portion, and a straight, lower portion. The upper portion has an outer, cylindrical surface, circular in cross-section, and is bent at an upper juncture between the upper and intermediate portions and at a lower juncture between the intermediate and lower portions. The upper and intermediate portions generally define an obtuse angle, and the intermediate and lower portions generally define an acute angle. A secondary strut has a proximal end, and a distal end is clamped at the proximal end of the secondary strut to the outer, cylindrical surface of the upper portion of the primary strut, above the upper juncture, so that the secondary strut can be adjustably oriented to project in any direction from the upper portion of the primary strut, and so that the secondary strut can be pivotally adjusted to any angle within a range so that the distal end can be higher than, level with, or lower than the proximal end.

Fey, in U.S. Pat. No. 5,873,201, describes a device supported by a roof structure utilizing a platform having first and second surfaces, where the second surface bears on the roof. The platform includes a slot between the first and second surfaces which accepts a slidable element. An element is formed with a flange and extending legs which form a chamber within the slot of the platform. The flange portion of the element is provided with an opening to accept a fastener which extends through the chamber into the roof. A filler material occupies the chamber and protects the fastener within the chamber.

In U.S. Pat. No. 6,237,888, Coll discloses an antenna mounting system for mounting an antenna mast to a building with a roof having a plurality of exposed rafters extending in spaced-apart parallel relationship, comprising a support member for holding the mast vertically at a predetermined distance from an edge of the roof; a torsion-resistant attachment member for attaching the support member to one of the rafters; and first and second mast stabilizing arms for maintaining the mast in a stable, generally vertical position so as to resist wind effects. The first mast stabilizing arm being adapted for attachment to the one rafter by the attachment member, and the second mast stabilizing arm being adapted for attachment to another rafter spaced from the one rafter. The first and second mast stabilizing arms cooperate with the support member to provide a structurally rigid antenna mounting system. The antenna mast mounted to rafters with such a system can withstand a wind load of up to about 100 mph.

Kruse, in U.S. Pat. No. 6,276,649, describes a triangular planar member that defines, through its thickness, four generally circular screw holes. The four holes may be disposed in relative relation to one another so as to generally define the corners of a rectangle. At the corners of the triangular planar member are corner couplers such as suction cups. The suction cups attach the adapter to the smooth surface. The holes in the adapter are utilized to accept screws in order to adapt, via the triangular planar member, a screw-mounted device to the smooth surface onto which it is either not possible or not desirable to screw-mount the device directly. In an optional embodiment of the present invention, the triangular planar member defines one hole and three slots for greater adaptability in terms of the types of devices it may receive.

In U.S. Pat. No. 6,460,821, Rhudy et al. disclose a DSS Uni-Mount, which is a ¼" aluminum plate that is designed to mount a standard DSS (small dish) mounting arm to the gable end or hip edge of most residences or structures. This device virtually eliminates the need for roof penetrations in order to mount a DSS satellite dish. The top of the DSS Uni-Mount is fabricated at a roof angle of 5 on 12 and is designed for application to the gable end of a structure. It accommodates roof pitches from 4 on 12 thru 8 on 12. The bottom is cut at 90 degrees to the sides thus enabling mounting to flat or hip portion of the roof line by inversion of the unit. A total of eight ⅜" diameter holes are drilled thru the Uni-Mount in strategic places to allow the installer to match the DSS mounting arm holes with the DSS Uni-Mount plate. Lag bolts and machine bolts are then screwed thru and to the DSS Uni-Mount in order to secure the DSS mounting arm to the gable or eaves of the roof line. The plate also accommodates the mounting of a dual grounding block, which enables electrical grounding of both the satellite antenna/mounting arm bracket and coax cable at a common junction point.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

SUMMARY OF THE INVENTION

The invention is directed to a curb and cap mounting assembly for installation on the roof or wall of a structure. The cap portion of the assembly is a flat top cover with down turned edges, and includes suitable hardware for mounting the base of a satellite dish on the flat top. The curb and cap mounting assembly comprises a curb member that includes a planar flashing portion with a central housing portion extending upwardly from the flashing portion and forming an enclosed space. The central housing portion has top and bottom openings. A cap member includes a planar top portion and a peripheral edge portion extending downwardly therefrom. The cap member is sized to fit over the top opening of the central housing portion and is reversibly fastened thereto. The cap member has fastening means secured to the planar top portion. The curb and cap mounting assembly is secured to a structure by the planar flashing portion and receives a communications cable from interior the structure through the bottom opening of the central housing portion into the enclosed space therein. The cable extends through the top opening of the central housing portion of the curb member and under the downward extending peripheral edge portion of the cap member and extends exterior the assembly. The mounting assembly is adapted to mount a communications antenna to the cap member planar top portion fastening means. The antenna is connected to the cable to deliver communications signals interior the structure. The cable can be prewired to the curb and cap mounting assembly until the owner desires to install the satellite dish on the structure.

Also disclosed is a method of mounting a satellite dish to a structure that prevents passage of water into the interior of the structure.

DESCRIPTION OF THE EMBODIMENTS

Nomenclature:

10 Curb and Cap Mounting Assembly
20 Curb Member
25 Planar Flashing Portion
27 Apertures in Flashing
30 Central Housing Portion
32 Vertical Sidewall
34 Notch in Sidewall
36 Enclosed Space of Central Housing
38 Fastener Apertures
40 Top Opening in Central Housing
45 Bottom Opening in Central Housing
50 Cap Member
55 Planar Top Portion
60 Peripheral Edge Portion
65 Fastener Apertures
70 Fasteners of Planar Top Portion
72 Apertures of Planar Top Portion
75 Gasket Member of Cap Member Construction:

The invention is directed to a curb and cap mounting assembly for installation on the roof or wall of a structure. The cap portion of the assembly is a flat top cover with down turned edges, and includes suitable hardware for mounting the base of a satellite dish on the flat top. The curb and cap mounting assembly comprises a curb member that includes a planar flashing portion with a central housing portion extending upwardly from the flashing portion and forming an enclosed space. The central housing portion has top and bottom openings. A cap member includes a planar top portion and a peripheral edge portion extending downwardly therefrom. The cap member is sized to fit over the top opening of the central housing portion and is reversibly fastened thereto. The cap member has fastening means secured to the planar top portion. The curb and cap mounting assembly is secured to a structure by the planar flashing portion and receives a communications cable from interior the structure through the bottom opening of the central housing portion into the enclosed space therein. The cable extends through the top opening of the central housing portion of the curb member and under the downward extending peripheral edge portion of the cap member and extends exterior the assembly. The mounting assembly is adapted to mount a communications antenna to the cap member planar top portion fastening means. The antenna is connected to the cable to deliver communications signals interior the structure. The cable can be prewired to the curb and cap mounting assembly until the owner desires to install the satellite dish.

Figure 1:
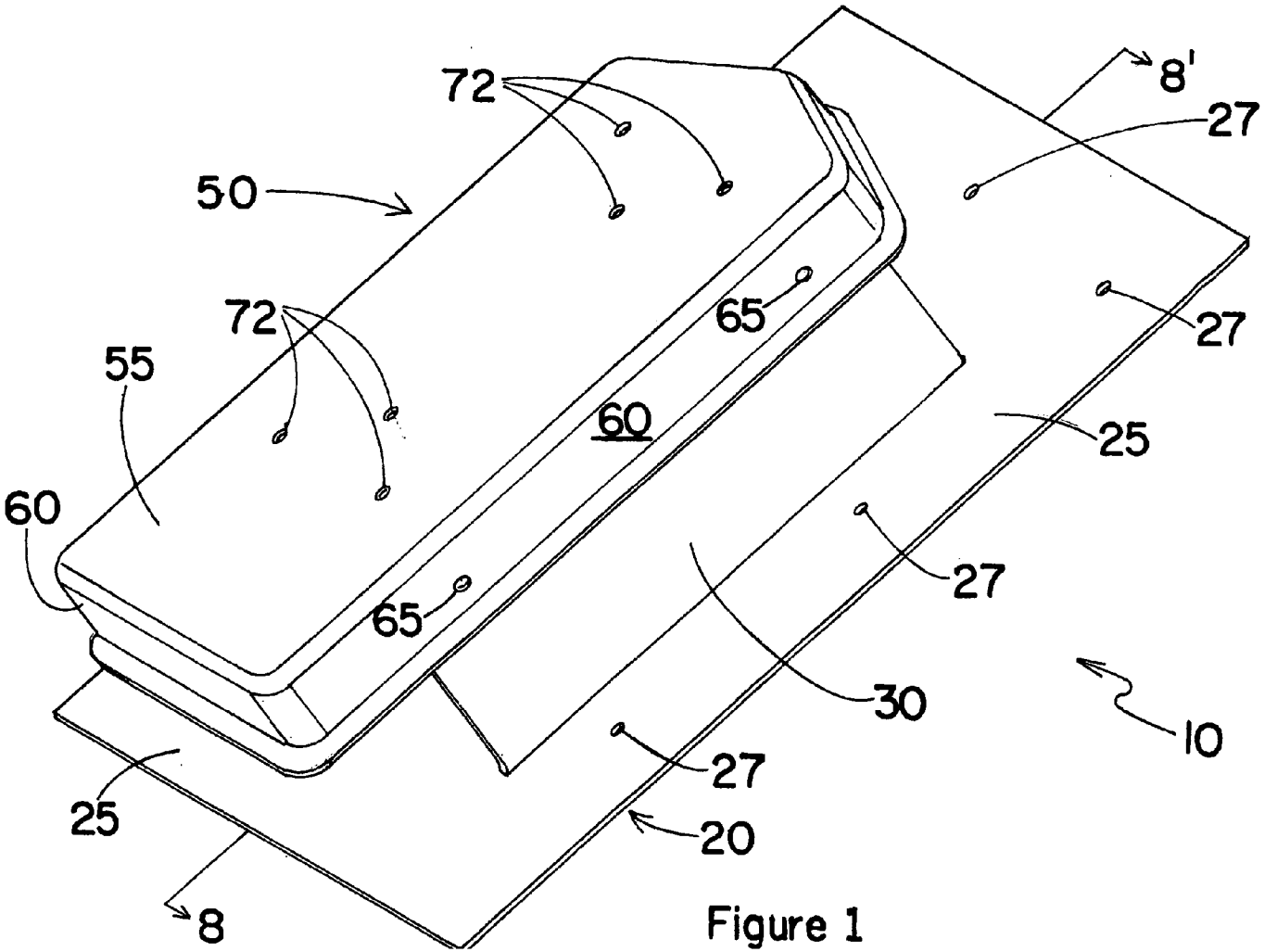
FIG. 1 is an elevational perspective view of one embodiment of the curb and cap mounting assembly of the present invention.
Figure 2:
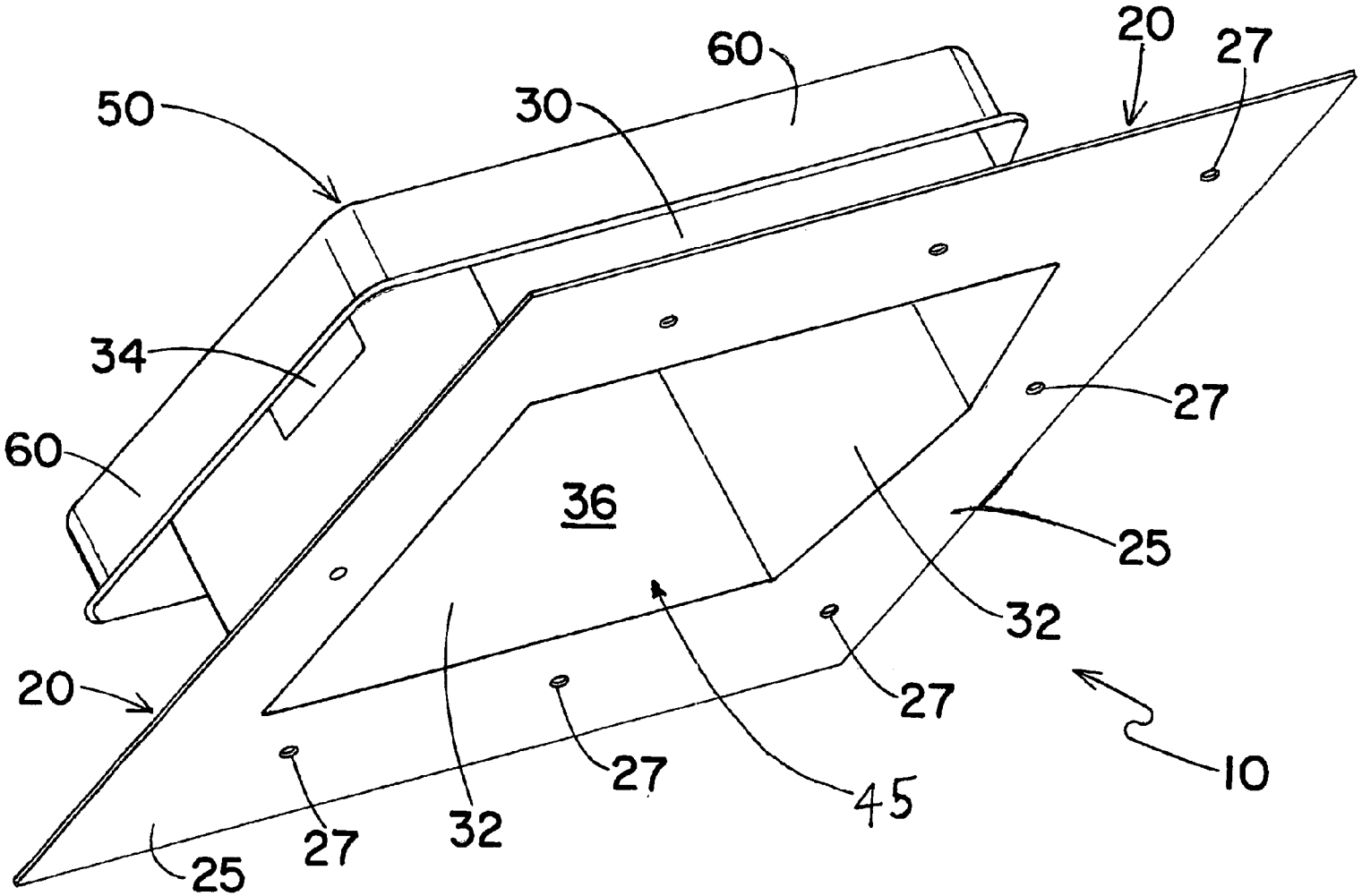
FIG. 2 is a bottom perspective view of the one embodiment of the curb and cap mounting assembly of the present invention.
Figure 3:
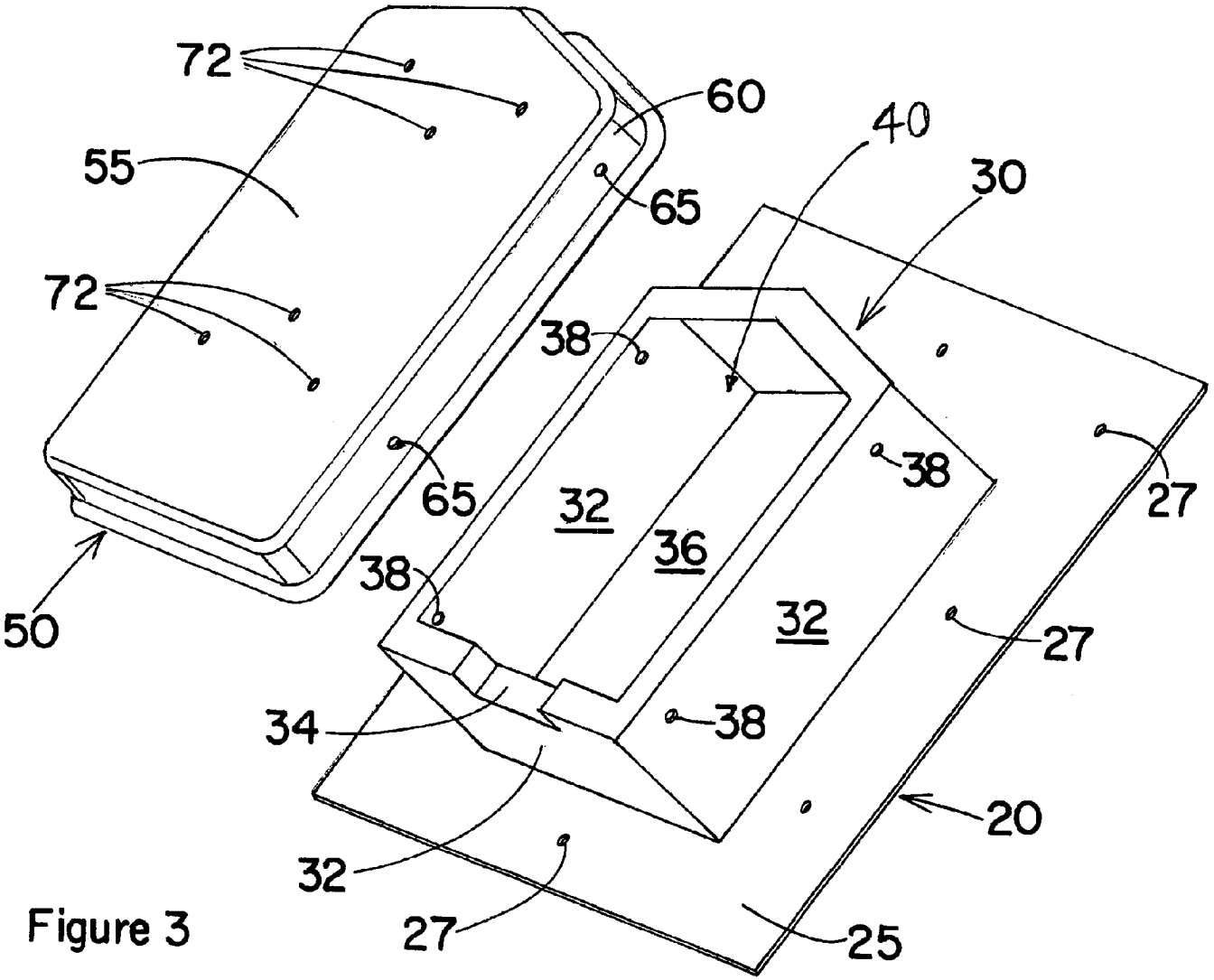
FIG. 3 is an exploded perspective view of the one embodiment of the curb and cap mounting assembly of the present invention.

Referring to FIGS. 1–3, several views of one embodiment of the curb and cap mounting assembly 10 are shown. The curb and cap mounting assembly 10 comprises a curb member 20, that includes a planar flashing portion 25 having a central housing portion 30 extending upwardly from the flashing portion 25 and forming an enclosed space 36 therein. The central housing portion 30 has a top opening 40 and a bottom opening 45, best seen in FIG. 3. The central housing portion 30 of the embodiment of FIGS. 1–3 includes five sidewalls 32 extending from the flashing portion 25. Preferably, the sidewalls 32 extend vertically from the flashing portion 25 and form a uniform top opening 40 for contacting the cap member 50. Most preferably, one of the vertical sidewalls 32 includes a notch 34 adjacent the central housing portion top opening 40. The sidewalls 32 include a plurality of fastener apertures 38 for securing the cap member 50 thereto.

Figure 5:
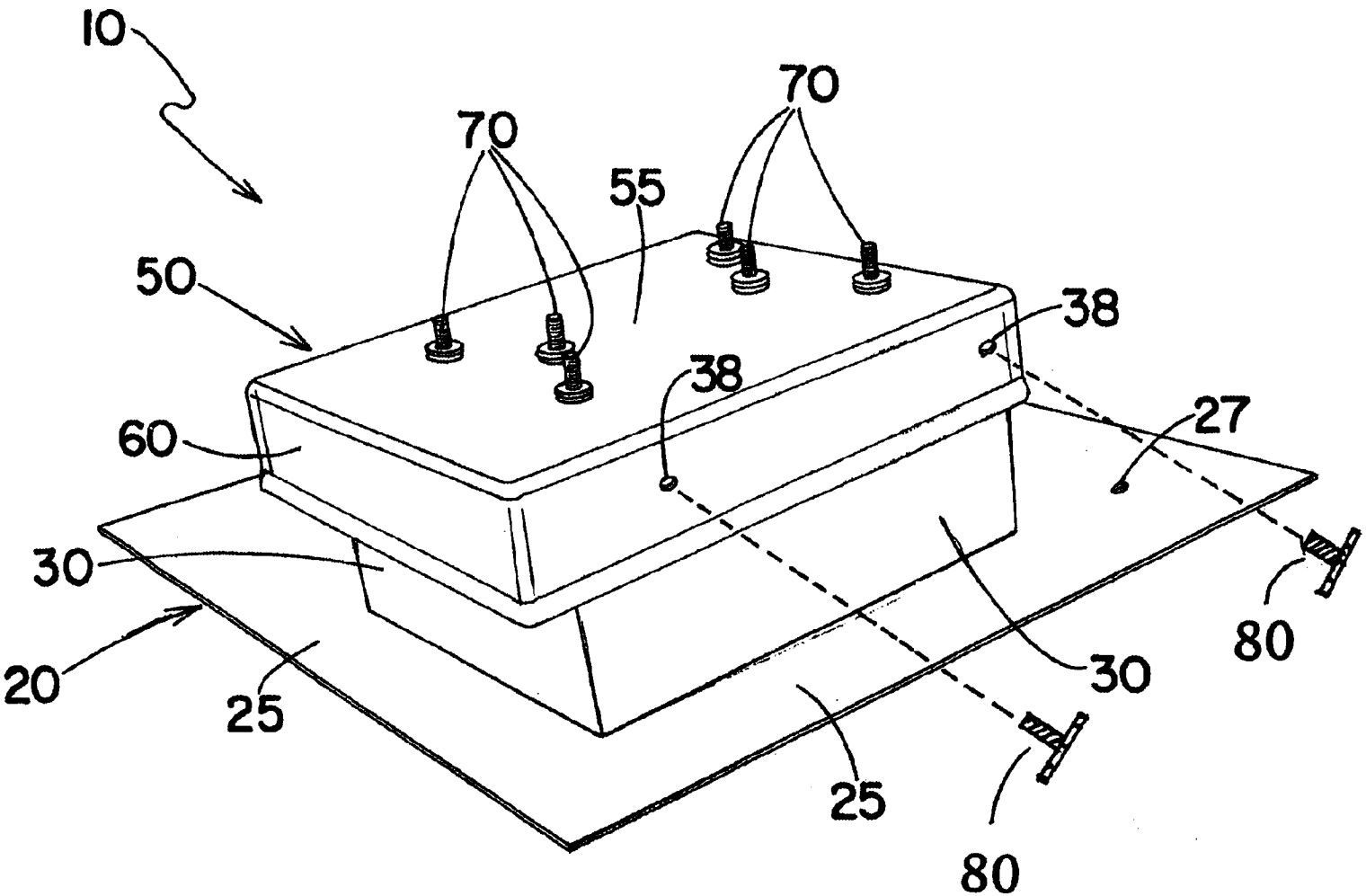
FIG. 5 is an elevational perspective view of the FIG. 4 embodiment of the curb and cap assembly of the present invention.

The cap member 50 has a planar top portion 55 and a peripheral edge portion 60 extending downwardly therefrom. The cap member 50 is sized to fit over the top opening 40 of the central housing portion 30 with a plurality of fastener apertures 65 positioned on the peripheral edge portion 60 in register with the fastener apertures 38 of the central housing portion 30. The cap member 50 fits tightly to the central housing portion 30. Threaded fasteners 80 inserted into the fastener apertures 38, 65 allow the cap member 50 to be reversibly fastened to the curb member 20. Preferably, the downwardly extending peripheral edge portion 60 of the cap member 50 flares outwardly from the central housing portion 30 at an end opposite the planar top portion 55. This feature facilitates shedding of water by the cap member 50. The cap member 50 includes a plurality of linear fasteners 70 secured to the planar top portion 55 for attachment of the base of a communications antenna. Preferably, the linear fasteners 70 extend upwardly from the planar top portion 55 opposite the central housing portion 30, as illustrated in FIG. 5.

Most preferably, the cap member 50 includes a section of peripheral edge portion 60 that is spaced apart from the central housing portion vertical wall 32 having the notch 34 therein. In order to seal the notch 34, a flexible gasket member 75 is secured interior the cap member 50 such that the gasket member 75 contacts and seals the notch 34 to prevent entry of water interior the curb member 20. The notch 34 provides a path for a communications cable from interior the assembly 10 to exterior the assembly 10. The gasket member 75 is selected from a foam material or a screen material, the screen material fabricated from either metal or plastic.

Figure 9:
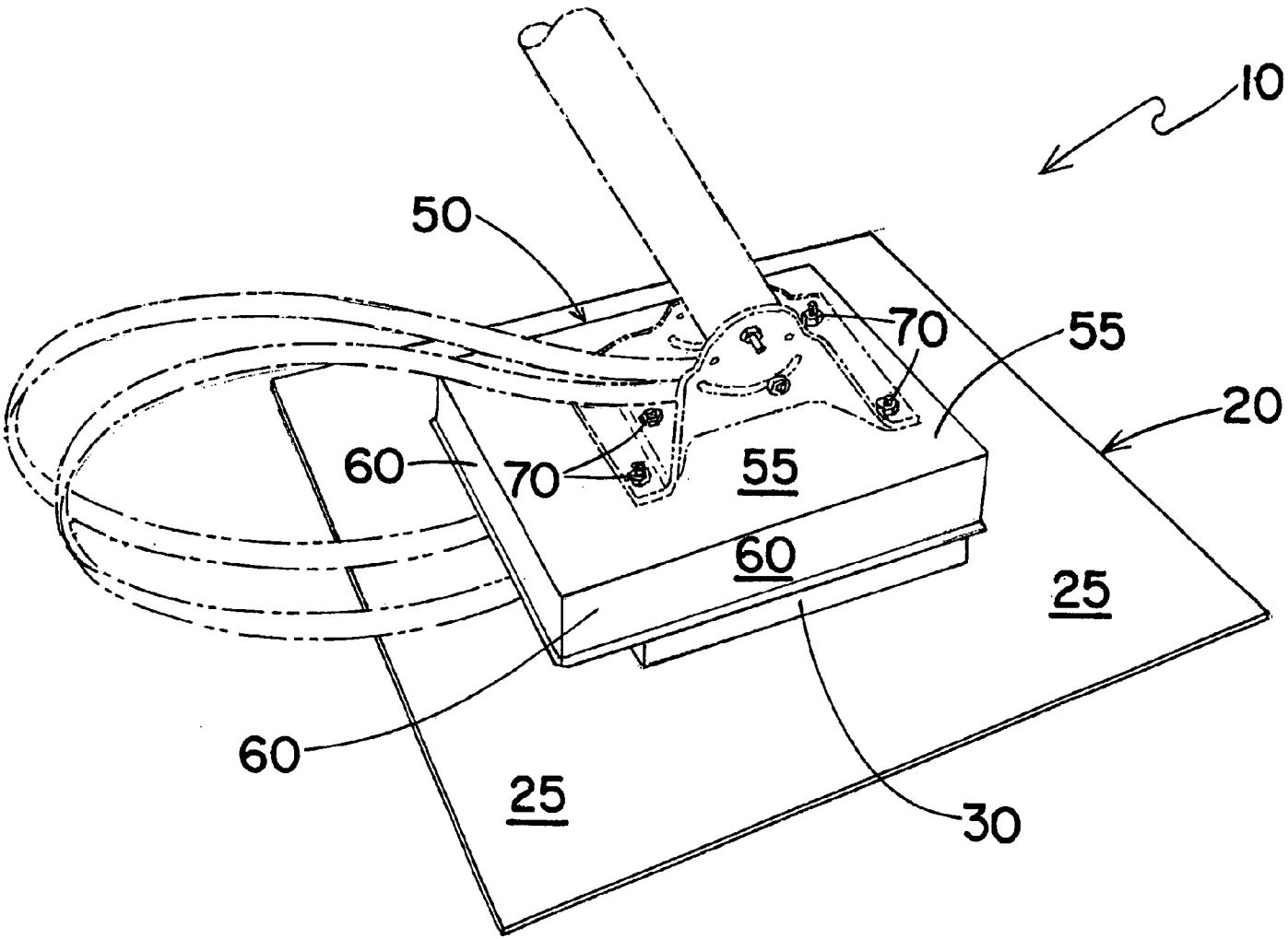
FIG. 9 is an elevational perspective view of one embodiment of the curb and cap mounting assembly of the present invention with a satellite dish mounting base secured thereto.

The curb and cap mounting assembly 10 is secured to a roof or wall of a structure by the planar flashing portion 25 by well-known techniques that prevent entry of water into the structure. Preferably, a plurality of apertures 27 are present in the flashing portion 25 for receiving fasteners (not shown) to secure the flashing portion 25 to the structure. The assembly 10 receives a communications cable from interior the structure through the bottom opening 45 of the central housing portion 30 into the enclosed space 36 therein. The cable extends through the top opening 40 of the central housing portion 30 and is positioned in the notch 34 of the curb member vertical sidewall 32 and extends exterior the curb and cap assembly 10. The gasket member 75 interior the cap member 50 contacts the cable in the notch 34 to form a water-tight seal. A communication receiver is secured to the upward extending fasteners 70 of the cap member 50 and is connected to the cable to deliver communications signals interior the structure. A communication receiver base mounted to the cap member 50 of the mounting assembly 10 is shown in FIG. 9.

The upwardly extending linear fasteners 70 of the cap member 50 can be permanently secured to the cap member 50 by welding or braising. Alternatively, the fasteners 70 can be removably mounted in apertures 72 in the cap member planar top portion 55. In the later embodiment, a fastener 70, such as bolts with threaded nuts, is positioned in each of the apertures 72 with the fastener heads either interior or exterior the cap member 50, and the nut on the opposite side. In this embodiment, one or more elastomeric washers may be provided for each fastener 70 to seal out water from interior the curb and cap mounting assembly 10.

Although the cap member 50 is described as having linear fasteners 70, other fastening means for securing the satellite dish base or plate to the cap member planar top portion 55 are contemplated. Various brackets or clamps secured to the planar top portion 55 can be adapted to securely fasten the base or plate of the satellite dish thereto.

Figure 4:
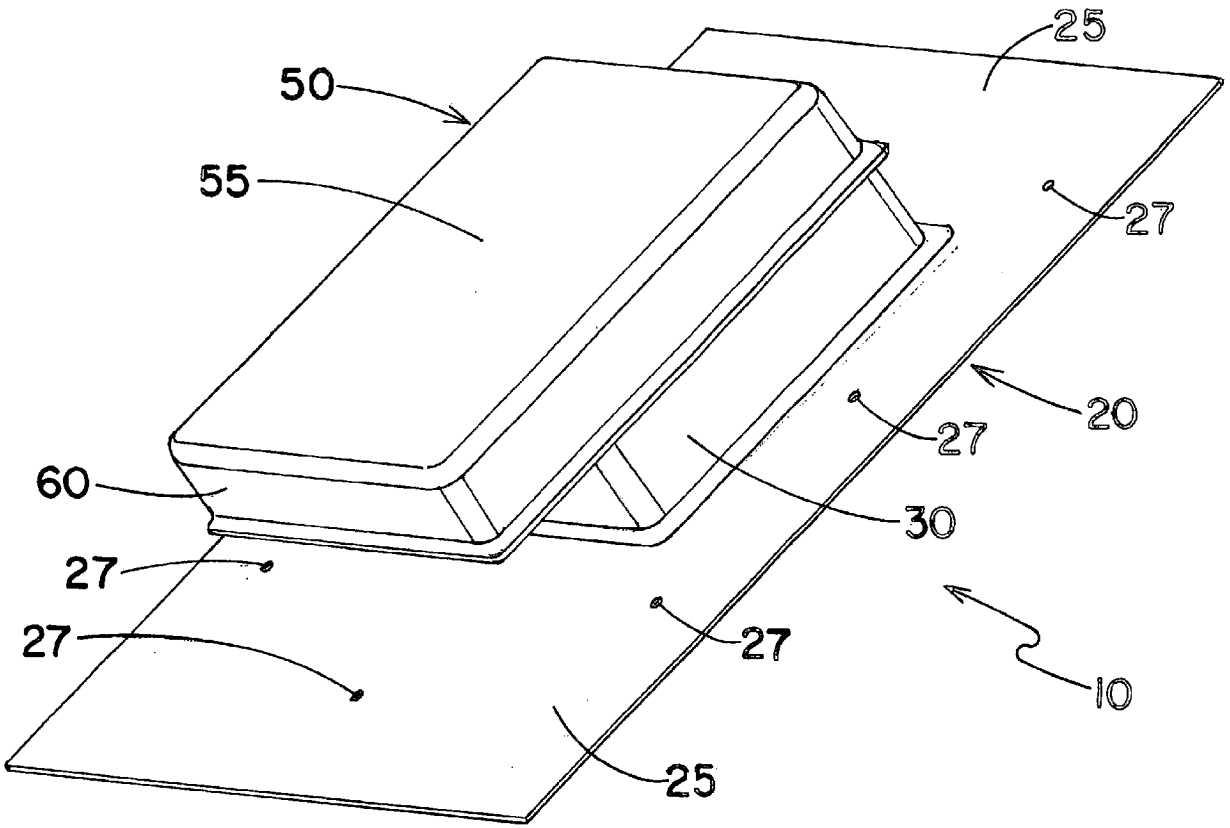
FIG. 4 is an elevational perspective view of the another embodiment of the curb and cap mounting assembly of the present invention.
Figure 6:
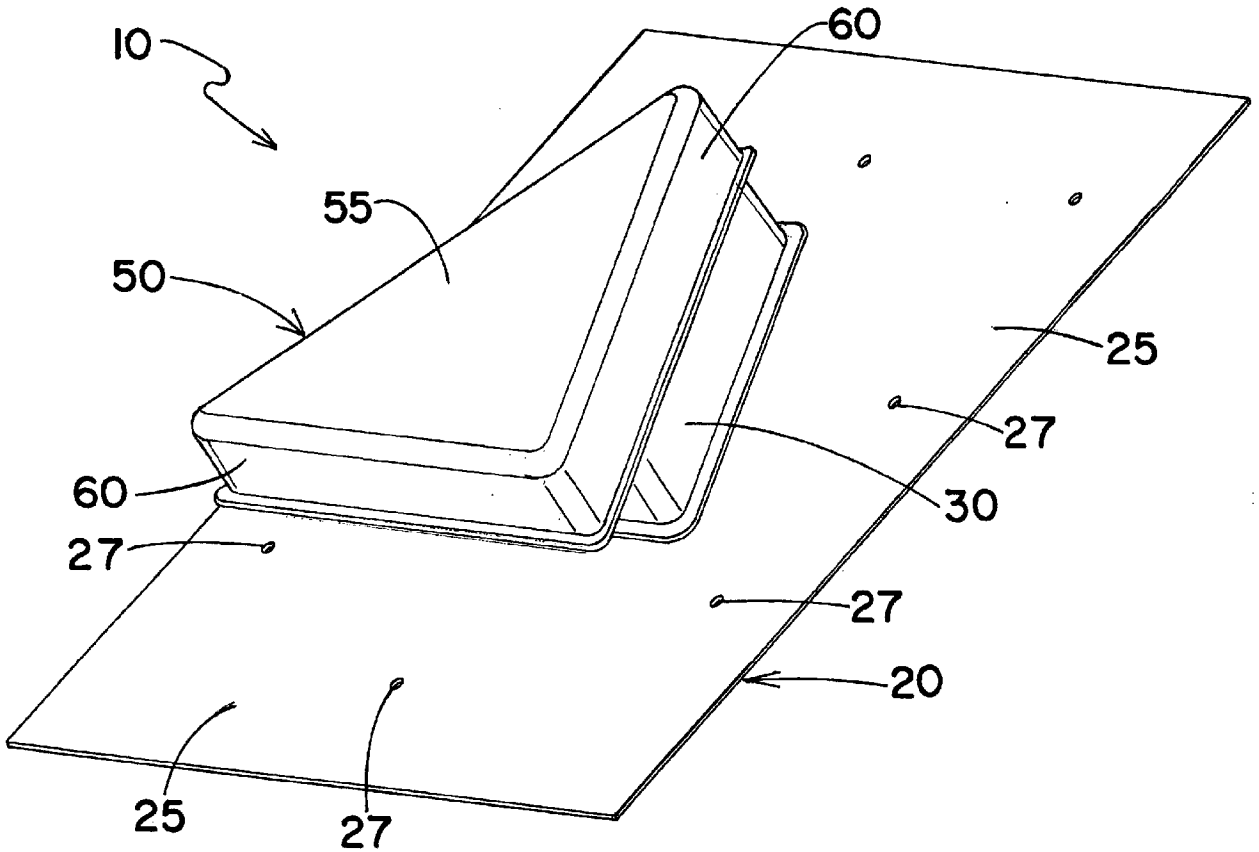
FIG. 6 is an elevational perspective view of yet another embodiment of the curb and cap assembly of the present invention.
Figure 7:
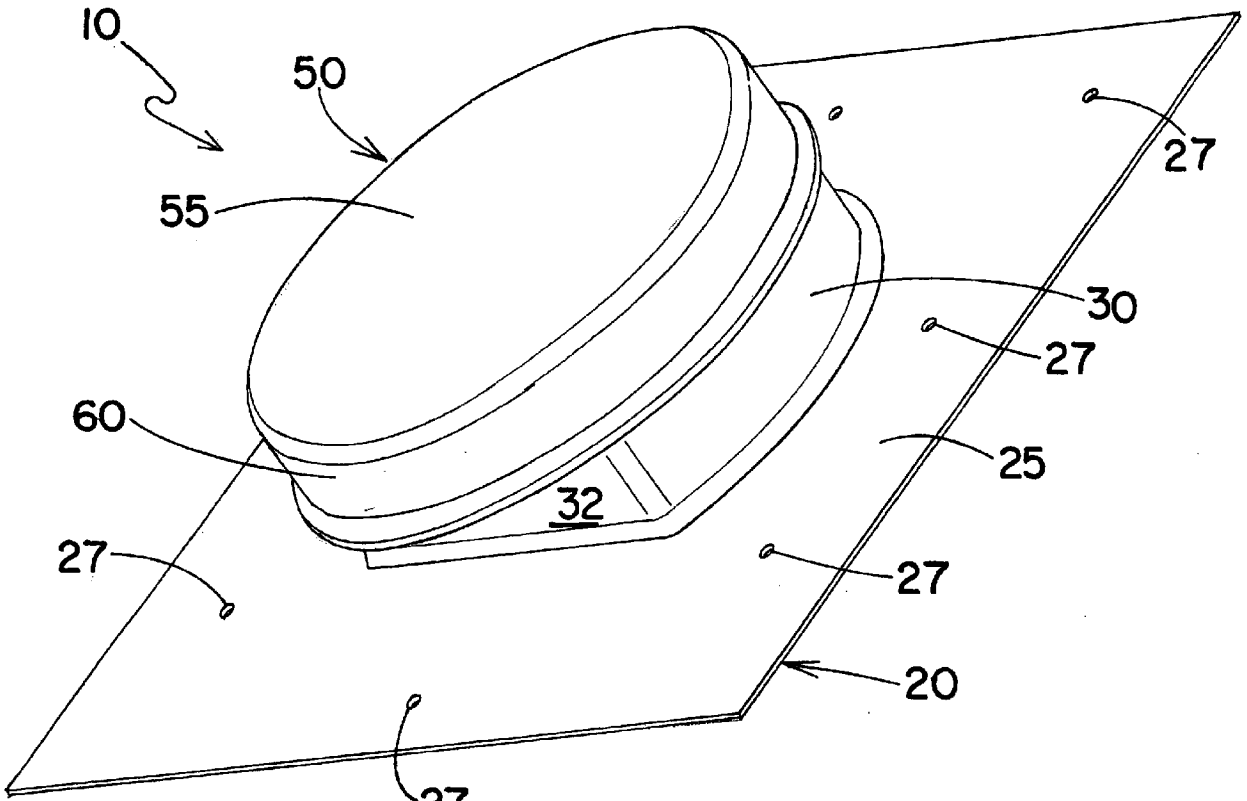
FIG. 7 is an elevational perspective view of yet another embodiment of the curb and cap assembly of the present invention.
Figure 8:
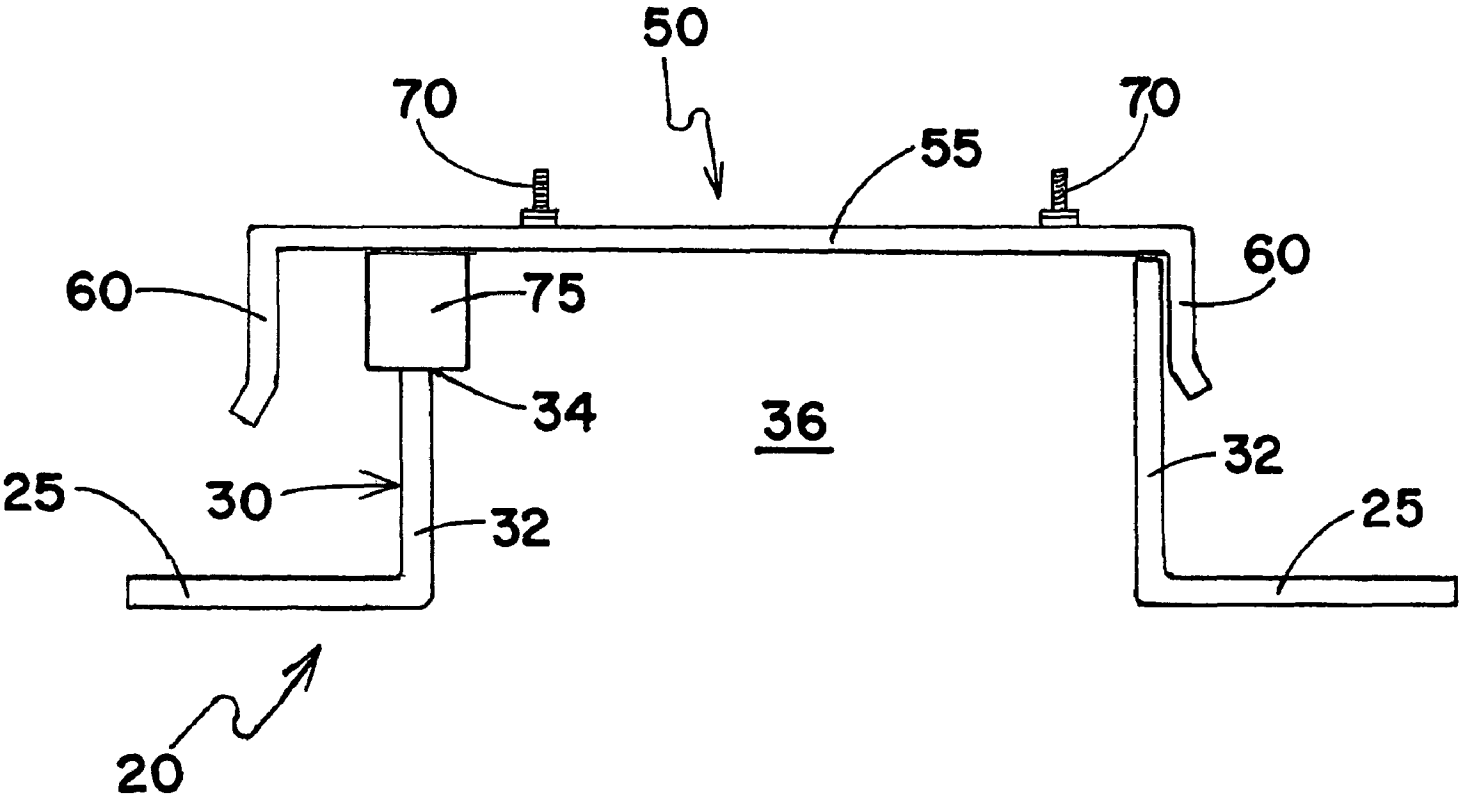
FIG. 8 is a cross sectional view along line 8–8' of the curb and cap mounting assembly of FIG. 1.

The curb and cap mounting assembly 10 of FIGS. 1–3 is mounted to a roof or wall of a structure with the point of the central housing portion 30 positioned at the highest elevation of the central housing portion 30 to divert water around the assembly 10. Although the curb and cap mounting assembly 10 of FIGS. 1–3 is shown with the central housing portion 25 and cap member 50 having five sidewalls 32, embodiments having greater or fewer numbers of sidewalls 32 are contemplated. FIGS. 4 and 5 disclose an assembly 10 with four sidewalls 32, providing a rectangular central housing portion 30 and a matching cap member 50. FIG. 6 discloses an assembly 10 with three sidewalls 32, providing a triangular central housing portion 30 and a matching cap member 50, and FIG. 7 discloses an assembly 10 with one sidewall 32, providing a circular central housing portion 30 and a matching cap member 50. In FIGS. 4, 6 and 7, the linear fasteners 70 and the fastener apertures 72 are omitted for clarity. Each of these embodiments of the curb and cap mounting assembly 10 preferably comprises a central housing portion 30 that includes at least one vertical sidewall 32 extending from the flashing portion 25. Most preferably, the at least one vertical sidewall 32 of the central housing portion 30 includes a notch 34 adjacent the top opening 40 of the central housing portion 30, for routing the communications cable from interior the assembly 10 to the exterior for connection to a communications satellite dish.

In a further embodiment of the invention, the curb and cap mounting assembly 10 includes a hinge member that connects the cap member 50 to the curb member 20. The hinge member is preferably secured between the central housing portion 30 of the curb member 20 and the cap member 50. Most preferably, the hinge member is positioned and fastened interior the central housing portion 30 and beneath the cap member 50 to protect the hinge member from the elements. The hinge member does not replace the fasteners that reversibly secure the cap member 50 to the central housing portion 30 of the curb member 20, but allows the cap member 50 to pivot away from the central housing portion 30 while maintaining the cap member 50 in close proximity to the curb member 20.

The invention also includes a method for mounting a communications antenna to a structure. The method includes the steps of first providing a curb and cap mounting assembly comprising; (i) a curb member including a planar flashing portion with a central housing portion extending upwardly from the flashing portion and forming an enclosed space, the central housing portion having top and bottom openings; and (ii) a cap member having a planar top portion and a peripheral edge portion extending downwardly therefrom, the cap member sized to fit over the top opening of the central housing portion and reversibly fastened thereto, the cap member having a plurality of fasteners secured to the planar top portion. Next, the curb and cap mounting assembly is secured to a structure by the planar flashing portion. Then, a communications cable is routed from interior the structure through the bottom opening of the central housing portion into the enclosed space therein, then through the top opening of the central housing portion of the curb member and under the downward extending peripheral edge portion of the cap member, and exterior the assembly. Next, a communications antenna is mounted to the cap member planar top portion fasteners. Finally, the communications antenna is connected to the cable to deliver communications signals interior the structure.

While the invention has been particularly shown and described with reference to preferred embodiments thereof, it will be understood by those skilled in the art that various changes in form and details may be made therein without departing from the spirit and scope of the invention.

We claim:

1. A curb and cap mounting assembly adapted for mounting a dish antenna to a structure comprising:

(a) a curb member including a planar flashing portion with a central housing portion extending vertically from the flashing portion and forming an enclosed space, the central housing portion including a plurality of fastener apertures there around and having top and bottom openings, the central housing portion including a notch adjacent the top opening, the curb member adapted for attachment to a structure via the planar flashing portion; and (b) a cap member having a planar top portion and a peripheral edge portion extending downwardly therefrom, the cap member sized to fit over the top opening of the central housing portion, the cap member's peripheral edge portion extending below the notch adjacent the top opening of the central housing portion, and including a plurality of fastener apertures in register with the fastener apertures of the central housing portion, and a like number of fasteners inserted through the aligned fastener apertures to reversibly fasten the cap member's peripheral edge portion to the curb member's central housing portion, the cap member further having a plurality of upward extending linear fasteners protruding from the planar top portion opposite the central housing portion, the linear fasteners adapted for fastening a communications antenna thereto;

(c) whereby, the curb and cap mounting assembly is adapted for securing to the structure by the planar flashing portion and is adapted to receive a communications cable extending from the interior of the structure directly beneath and through the bottom opening of the central housing portion into the enclosed space therein, the cable being extendable over the vertical central housing portion of the curb member through the notch therein and further extending under the downward extending peripheral edge portion of the cap member and extending exterior the assembly, the mounting assembly being adapted to mount a communications antenna to the cap member by the upward extending linear fasteners, the antenna being adapted for connection to the cable to deliver communications signals interior the structure.

2. The curb and cap mounting assembly of claim 1, wherein the central housing portion includes at least one vertical sidewall.

3. The curb and cap mounting assembly of claim 1, wherein a section of the cap member peripheral edge portion is spaced apart from the central housing portion having the notch therein.

4. The curb and cap mounting assembly of claim 1, further including a gasket member secured interior the cap member, the gasket member contacting the notch adjacent the central housing portion top opening.

5. The curb and cap mounting assembly of claim 4, wherein the gasket member is selected from the group consisting of foam material and screen material.

6. The curb and cap mounting assembly of claim 1, wherein the downwardly extending peripheral edge portion of the cap member flares outwardly from the central housing portion at an end opposite the planar top portion thereof.

7. The curb and cap mounting assembly of claim 1, wherein the upwardly extending linear fasteners of the cap member are threaded studs rigidly fastened to the planar top portion thereof.

8. The curb and cap mounting assembly of claim 1, wherein the upwardly extending linear fasteners of the cap member are threaded bolts mounted in apertures in the planar top portion thereof.

9. The curb and cap mounting assembly of claim 1, wherein the curb member and cap member are fabricated from corrosion resistant sheet metal material.

10. A curb and cap mounting assembly adapted for mounting a dish antenna to a roof structure comprising:

(a) a curb member including a planar flashing portion with a central housing portion with at least one sidewall extending vertically from the flashing portion and forming an enclosed space, the central housing portion having top and bottom openings, the at least one vertical sidewall of the central housing portion including a plurality of fastener apertures therein and including a notch adjacent the central housing portion top opening, the curb member adapted for attachment to a roof structure via the planar flashing portion; and (b) a cap member having a planar top portion and a peripheral edge portion extending downwardly therefrom, the cap member sized to fit over the top opening of the central housing portion, the planar top portion contacting the at least one vertical sidewall except at the notch therein, the cap member's peripheral edge portion extending below the notch adjacent the top opening of the central housing portion, and including a plurality of fastener apertures in register with the fastener apertures of the at least one sidewall, and a like number of fasteners inserted through the aligned fastener apertures to reversibly fasten the cap member's peripheral edge portion to the curb member's central housing portion, a section of the cap member peripheral edge portion spaced apart from the central housing portion at least one vertical sidewall having the notch therein, a foam gasket member secured interior the cap member, the foam gasket member contacting the notch in the at least one vertical sidewall, the cap member further having a plurality of upward extending linear fasteners protruding from the planar top portion opposite the central housing portion, the linear fasteners adapted for fastening a communications antenna thereto;

(c) whereby, the curb and cap mounting assembly is adapted for securing to the roof structure by the planar flashing portion and is adapted to receive a communications cable extending from interior the roof structure directly beneath and through the bottom opening of the central housing portion into the enclosed space therein, the cable being extendable over the vertical central housing portion of the curb member through the notch therein, and further extending under the downward extending peripheral edge portion of the cap member and extending exterior the assembly, the mounting assembly being adapted to mount a communications antenna to the cap member by the upward extending linear fasteners, the antenna being adapted for connection to the cable to deliver communications signals interior the roof structure.

11. The curb and cap mounting assembly of claim 10, wherein the downwardly extending peripheral edge portion of the cap member flares outwardly from the central housing portion at an end opposite the planar top portion thereof.

12. The curb and cap mounting assembly of claim 10, wherein the upwardly extending linear fasteners of the cap member are threaded studs rigidly fastened to the planar top portion thereof.

13. The curb and cap mounting assembly of claim 10, wherein the upwardly extending linear fasteners of the cap member are threaded bolts mounted in apertures in the planar top portion thereof.

14. The curb and cap mounting assembly of claim 10, wherein the curb member and cap member are fabricated from corrosion resistant sheet metal material.

15. A method for mounting a communications antenna to a structure comprising the steps:

(a) providing a curb and cap mounting assembly comprising:

(i) a curb member including a planar flashing portion with a central housing portion extending upwardly from the flashing portion and forming an enclosed space, the central housing portion including a plurality of fastener apertures there around and having top and bottom openings, the central housing portion including a notch adjacent the top opening, the curb member adapted for attachment to a structure via the planar flashing portion; and (ii) a cap member having a planar top portion and a peripheral edge portion extending downwardly therefrom, the cap member sized to fit over the top opening of the central housing portion, the cap member's peripheral edge portion extending below the notch adjacent the top opening of the central housing portion, and including a plurality of fastener apertures in register with the fastener apertures of the central housing portion, and a like number of fasteners inserted through the aligned fastener apertures to reversibly fasten the cap member's peripheral edge portion to the curb member's central housing portion, the cap member further having a plurality of linear fasteners secured to the planar top portion protruding opposite the central housing portion, the linear fasteners adapted for fastening a communications antenna thereto;

(b) securing the curb and cap mounting assembly to a structure by the planar flashing portion;

(c) routing a communications cable from interior the structure directly beneath and through the bottom opening of the central housing portion into the enclosed space therein, then through the notch adjacent the top opening of the central housing portion of the curb member and then under the downward extending peripheral edge portion of the cap member, and then exterior the assembly;

(d) mounting a communications antenna to the cap member planar top portion by the linear fasteners; and (e) connecting the communications antenna to the cable to deliver communications signals interior the structure.

16. A system for routing a communications antenna signal from exterior a structure to interior a structure via a continuous conductor for the signal, comprising;

(a) a curb and cap mounting assembly adapted for mounting a communications antenna including;

(i) a curb member including a planar flashing portion with a central housing portion having at least one sidewall extending vertically from the flashing portion and forming an enclosed space, the central housing portion having top and bottom openings, the at least one vertical sidewall of the central housing portion including a plurality of fastener apertures therein and including a notch adjacent the central housing portion top opening, the curb member adapted for attachment to a structure via the planar flashing portion; and (ii) a cap member having a planar top portion and a peripheral edge portion extending downwardly therefrom, the cap member sized to fit over the top opening of the central housing portion, the planar top portion contacting the at least one vertical sidewall except at the notch therein, the cap member's peripheral edge portion including a plurality of fastener apertures in register with the fastener apertures of the at least one sidewall, and a like number of fasteners inserted through the aligned fastener apertures to reversibly fasten the cap member's peripheral edge portion to the curb member's central housing portion, a section of the cap member peripheral edge portion spaced apart from the central housing portion at least one vertical sidewall having the notch therein, a foam gasket member secured interior the cap member, the foam gasket member contacting the notch in the at least one vertical sidewall, the cap member further having a plurality of upward extending linear fasteners protruding from the planar top portion opposite the central housing portion, the linear fasteners adapted for fastening a communications antenna thereto; and (b) a continuous communications cable having first and second ends, the cable adapted for attachment at a first end to a communications antenna mounted on the curb and cap mounting assembly, the cable routed from the communications antenna, first under the downward extending peripheral edge portion of the cap member and then into the enclosed space of the central housing portion through the notch therein, the cable then routed out the bottom opening of the central housing portion, and then through the structure directly beneath the central housing portion's bottom opening to interior the structure, the second end of the cable adapted for attachment to a communications signal receiver.

* * * * *